US006565014B1

(12) United States Patent
Hsieh

(10) Patent No.: US 6,565,014 B1
(45) Date of Patent: May 20, 2003

(54) WAVE GENERATOR

(76) Inventor: Max Hsieh, P.O. Box 2103, Taichung (TW)

( * ) Notice: Subject to any disclaimer, the term of this patent is extended or adjusted under 35 U.S.C. 154(b) by 0 days.

(21) Appl. No.: 10/200,197

(22) Filed: Jul. 23, 2002

(30) Foreign Application Priority Data

Dec. 21, 2001 (TW) ..... 90222543 U

(51) Int. Cl.[7] ..... B05B 15/02; F23D 11/38
(52) U.S. Cl. ..... 239/117; 239/441
(58) Field of Search ..... 239/104, 114, 239/115, 116, 117, 123, 436, 437, 438, 440, 441, 443, 446, 447, 448, 449

(56) References Cited

U.S. PATENT DOCUMENTS 2,989,249 A * 6/1961 Richter ..... 239/427
5,957,387 A * 9/1999 Porta et al. ..... 239/312
2002/0113145 A1 * 8/2002 Wong ..... 239/446

FOREIGN PATENT DOCUMENTS

DE 4039329 A1 * 7/1991 ..... B05B/1/18

* cited by examiner

*Primary Examiner*—Robert M. Fetsuga
*Assistant Examiner*—Lina R Kontos
(74) *Attorney, Agent, or Firm*—Rosenberg, Klein & Lee

(57) ABSTRACT

A wave generator including a base seat and an annular adjustment seat. A bottom face of the base seat is formed with a bubbling hole. Multiple sprinkling holes are formed along the circumference of the bubbling hole. The bottom edge of the adjustment seat is formed, with multiple downward extending parallel cleaning pins respectively corresponding to the sprinkling holes. When a user moves the base seat upward, permitting the water to flow out from the bubbling hole, the cleaning pins are respectively passed through the sprinkling holes to push out and clear off the dirt attaching to the wall faces of the sprinkling holes.

6 Claims, 6 Drawing Sheets

WAVE GENERATOR

BACKGROUND OF THE INVENTION

A present invention is related to an improved wave generator adaptable to a faucet. The wave generator includes cleaning pins which are able to conveniently clear off dirt clogging the water outlets.

FIGS. 4*a* to 5*b* show a conventional multistage adjustable sprinkler. A center of the sprinkler is formed with multiple water outlets 71. A periphery of the sprinkler is formed with multiple sprinkling holes 72. A user can turn a rotary disc to selectively discharge the water from the outlets 71 or the sprinkling holes 72.

A ring 74 and a fixing tray 75 are disposed in the sprinkler. The ring 74 is rotatable along with the rotary disc. The circumference of the ring 74 facing the sprinkling holes 72 is formed with multiple projecting cleaning pins 741 corresponding to the sprinkling holes 72. The circumference of the ring 74 is further formed with multiple projecting blocks 742 distal from the sprinkling holes 72. The fixing tray 75 is formed with upward inclined guide faces 751 corresponding to the projecting blocks 742 of the ring 74.

When a user desires to clean the sprinkling holes 72, the user can turn the rotary disc to rotate the ring 74. The projecting blocks 742 of the ring 74 will move upward along the guide faces 751 of the fixing tray 75. Accordingly, the cleaning pins 741 will extend out through the sprinkling holes 72 to clean up the dirt clogging the sprinkling holes 72.

The center of a domestic wave generator is formed with a bubbling hole. The periphery of the wave generator is formed with multiple sprinkling holes. In the case that dirty accumulates on the wall of the sprinkling hole, the water flowing through the sprinkling hole will impact the dirt and irregularly sprinkle. This affects the using state. For example, the irregularly sprinkling water will splash onto the clothes of the user or wet unexpected area such as the floor. This leads to inconvenience. Therefore, it is also necessary to clean the sprinkling holes of the wave generator.

The aforesaid cleaning structure can be applied to the wave generator. However, the wave generator is screwed on a connector provided with a circular connector 51 (with reference to FIG. 1), whereby a user can move the wave generator to change the angle thereof so as to adjust the sprinkling direction of the water flow. In the case that the rotary disc of the sprinkler is applied to the wave generator, when turning the rotary disc, the wave generator will be moved along with the rotary disc. Accordingly, the user needs to hold the wave generator with the other hand. This is troublesome.

Moreover, even if the wave generator is fixed and the angle thereof is unchangeable, when turning the rotary disc, the screwed section of the wave generator will be unscrewed from the connector and loosened.

In addition, the interior space of the wave generator is much smaller than that of the sprinkler. Therefore, the rotary disc must be minified. As a result, the force arm (radius of the rotary disc) is greatly shortened. Therefore, the user must exert a greater force for turning the rotary disc. Also, the user's fingers are hard to well touch and turn the minified rotary disc.

Moreover, the volume and internal space of the wave generator are relatively small so that it is hard to additionally mount the fixing tray and rotary disc therein. When mounting these minified parts into the small space of the wave generator, it is difficult to accurately assemble these parts.

SUMMARY OF THE INVENTION

It is therefore a primary object of the present invention to provide an improved wave generator in which the bottom edge of the adjustment seat is formed with multiple downward extending cleaning pins respectively corresponding to the sprinkling holes. When a user upward moves the base seat, permitting the to flow out from the central bubbling hole, the cleaning pins are passed through the sprinkling holes to push out and remove the dirt attaching to the wall faces of the sprinkling holes. Therefore, it is convenient to clean up the sprinkling holes.

It is a further object of the present invention to provide the above wave generator in which when cleaning the sprinkling holes, the base seat is pulled up and down, whereby the cleaning pins can relatively extend through the sprinkling holes to clean the same. The base seat is linearly moved and not rotated so that the problems resulting from small volume of the wave generator and the difficulty in assembling the parts are eliminated.

It is still a further object of the present invention to provide the above wave generator in which the base seat is often kept in an upward moved state, permitting the water to flow out from the bubbling hole. Therefore, in normal state, the cleaning pins are passed through the sprinkling holes so that the dirt is harder to attach to the wall faces of the sprinkling holes.

The present invention can be best understood through the following description and accompanying drawings wherein:

DETAILED DESCRIPTION OF THE PREFERRED EMBODIMENTS

Figure 1:
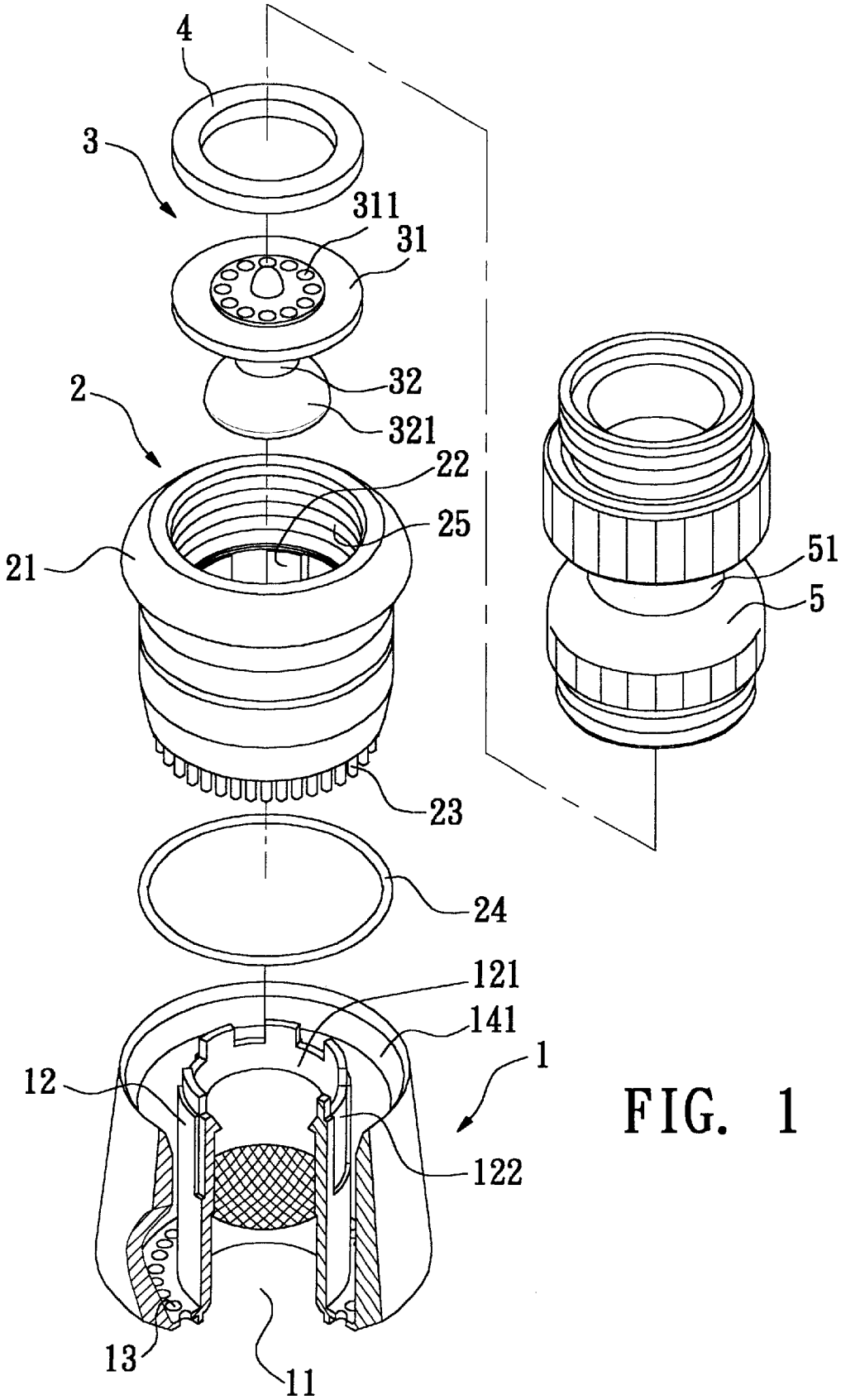
FIG. 1 is a perspective exploded view of the present invention.

Please refer to FIGS. 1 to 3. The wave generator of the present invention includes an up and down movable base seat 1 and an adjustment seat 2. The base seat 1 is integrally molded. The top edge of the base seat 1 is inward and downward formed with a slope 141. The base seat 1 is hollow. The center of the bottom face of the base seat 1 is formed with a bubbling hole 11 axially passing through the base seat 1. A hollow column 12 upward extends from the circumference of the bubbling hole 11. The top edge of the hollow column 12 has an inward extending annular rib 121. The outer face of the hollow column 12 is formed with multiple annular arranged locating dents 122. The locating dents 122 axially extend up to the top of the base seat.

The bottom face of the base seat 1 is further formed with multiple annularly arranged sprinkling holes 13 vertically passing through the bottom face. The sprinkling holes 13 are positioned between the hollow column 12 and the inner wall face of the base seat 1.

The adjustment seat 2 is annularly shaped and inserted between the hollow column 12 and the inner wall face of the base seat 1. The inner wall face of the adjustment seat 2 and the outer wall face of the hollow column 12 define therebetween a flow space 27. An O-ring is fitted around the adjustment seat 2. The O-ring has an outer diameter larger than the inner diameter of the base seat 1. The bottom edge of the adjustment seat 2 is formed with multiple downward extending parallel cleaning pins 23 respectively corresponding to the sprinkling holes 13. The outer diameter of the cleaning pin 23 is equal to the diameter of the sprinkling hole 13.

The top section of the adjustment seat 2 is formed with an inner thread section 25 for screwing on a connector 5. Via the connector 5, the wave generator is mounted on a faucet. In addition, the top section of the adjustment seat 2 has an outward projecting flange 21 having an outer diameter larger than the inner diameter of the top edge of the base seat 1. The bottom face of the flange 21 is formed with a downward and inward inclined slope 211 corresponding to the slope 141 of the base seat 1.

The inner wall face of the adjustment seat 2 is formed with an inward extending annular support section 26 under the inner thread section 25. The inner wall face of the adjustment seat 2 is formed with multiple inward projecting locating blocks 22 below the support section 26 corresponding to the locating dents 122. A switch member 3 is additionally disposed in the adjustment seat 2. The top of the switch member 3 has a tray 31 with an outer diameter larger than the inner diameter of the support section 26. The tray 31 is supported on the support section 26. A resilient washer 4 is positioned on the tray 31. When the adjustment seat 2 is screwed on the connector 5, the tray 31 and the washer 4 are right compressed between the support section 26 and the bottom edge of the connector 5. The resilient washer 4 serves to stably fix the tray 31.

The tray 31 is formed with multiple water orifices 311 vertically passing through the tray 31. The water orifices 311 communicate with the flow space 27. The center of the tray 31 has a downward extending stem 32 with an outer diameter smaller than the inner diameter of the annular rib 121. The stem 32 is inserted in the hollow column 12. The stem 32 and the annular rib 121 define therebetween a passage 15. The circumference of the end of the stem 32 is formed with an outward projecting stop section 321 with an outer diameter larger than the inner diameter of the annular rib 121, while smaller than the inner diameter of the hollow column 12. Therefore, the water can pass through the interior of the hollow column 12.

When fitting the adjustment seat 2 into the base seat 1, the O-ring 24 abuts against inner wall face of the base seat 1, whereby the adjustment seat 2 can be straightly fitted into the base seat 1 without deflecting. When the slope 141 of the top section of the base seat 1 contacts with the slope 211 of the adjustment seat 2, the two slopes 141, 211 guide each other to ensure that the adjustment seat 2 be straightly fitted into the base seat 1. When the base seat 1 is fitted with the adjustment seat 2, the locating blocks 22 are inserted into the locating dents 122 to prevent the base seat 1 from rotating. Also, the cleaning pins 23 are just passed through the sprinkling holes 13.

In addition, the top section of the adjustment seat 2 has a flange 21 larger than the inner diameter of the top edge of the base seat 1. Therefore, when the user pushes the base seat 1 upward, the flange 21 will stop the top edge of the base seat 1 to prevent the base seat 1 from upward detaching from the adjustment seat 2. The stop section 321 of the stem 32 of the switch member 3 is larger than the inner diameter of the annular rib 121 of the hollow column 12. Therefore, when the user downward pulls the base seat 1, the stop section 321 will stop the annular rib 121 of the hollow column 12 to prevent the base seat 1 from downward detaching from the adjustment seat 2.

Figure 2B:
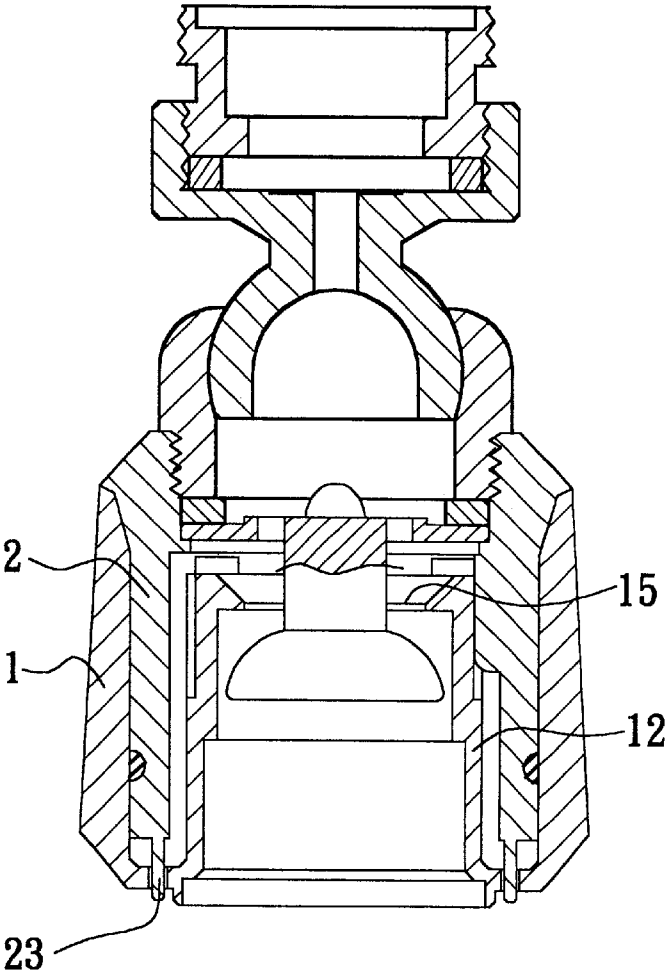
FIG. 2*b* is a sectional view of the present invention, showing that the base seat is moved upward, permitting the water to flow out from the bubbling hole, in which the cleaning pins are respectively passed through the sprinkling holes.
Figure 2A:
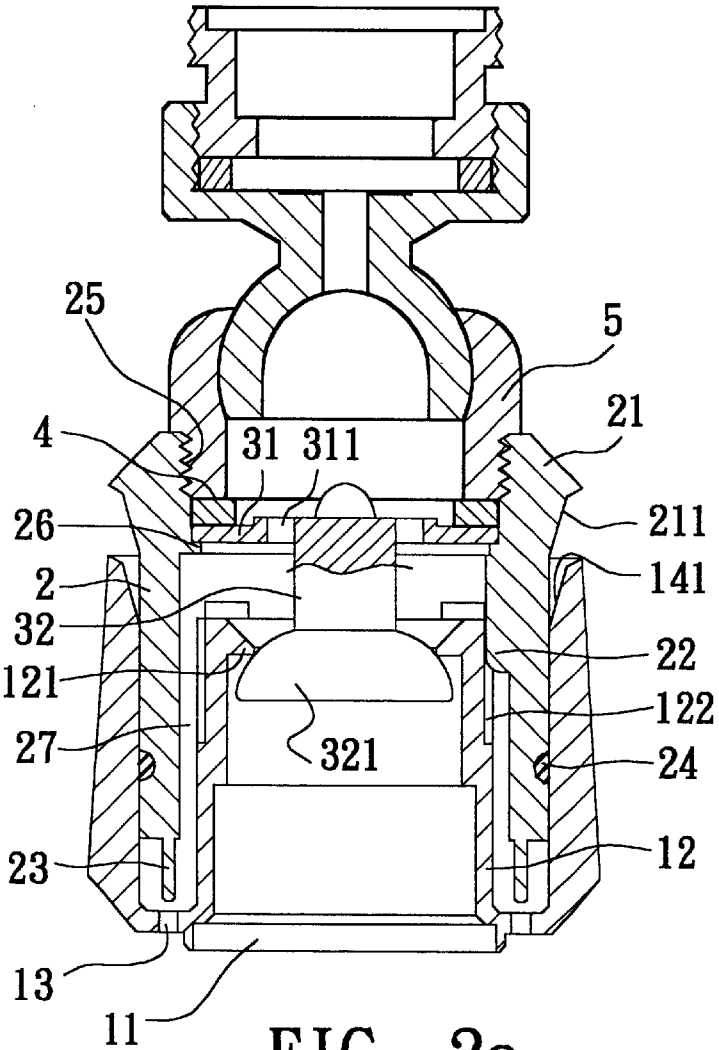
FIG. 2*a* is a sectional view of the present invention, showing that the base seat is pulled downward, permitting the water to flow out from the circumferential sprinkling holes.

Referring to FIG. 2*a*, when the user downward pulls the base seat 1 and the stop section 321 stops the annular rib 121 of the hollow column 12, the water orifices 311 of the tray 31 cannot flow between the annular rib 121 and the stop section 321 and will flow out of the circumferential sprinkling holes 13 through the flow space 27.

Referring to FIG. 2*b*, when the user pushes the base seat 1 upward, the annular rib 121 of the hollow column 12 is moved upward. At this time, the water passing through the water orifices is permitted to flow through the passage 15 into the hollow column 12 and then flow out from the bubbling holes 11 to form water flow with bubbles. This pertains to prior art and will not be further described.

Figure 3B:
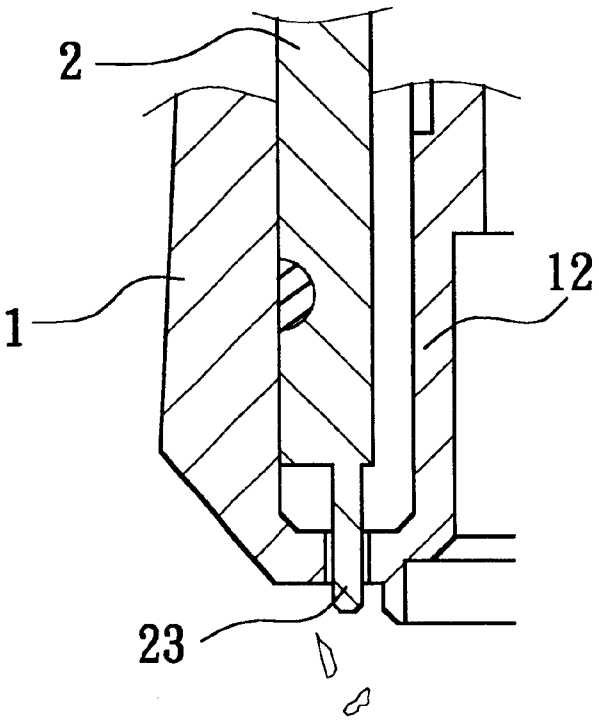
FIG. 3*b* is a sectional view showing that when the base seat is moved upward, the dirt attaching to the wall face of the sprinkling hole is pushed out by the cleaning pin.
Figure 3A:
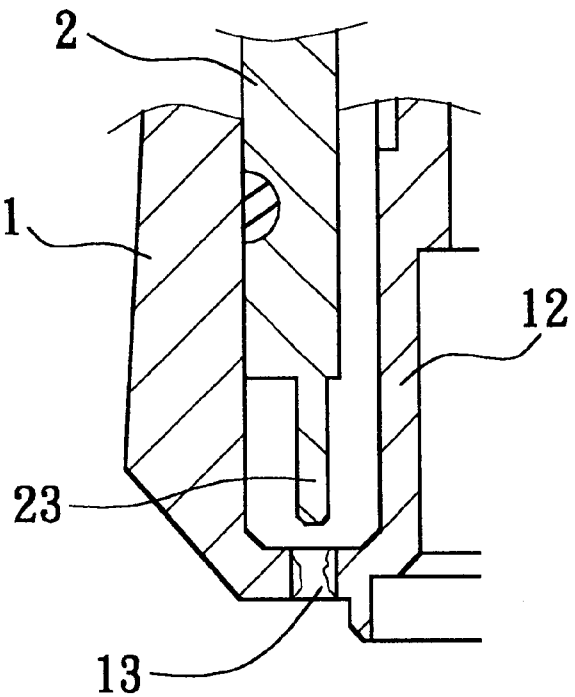
FIG. 3*a* is a sectional view showing that the dirt attaches to the wall face of the sprinkling hole.
Figure 4A:
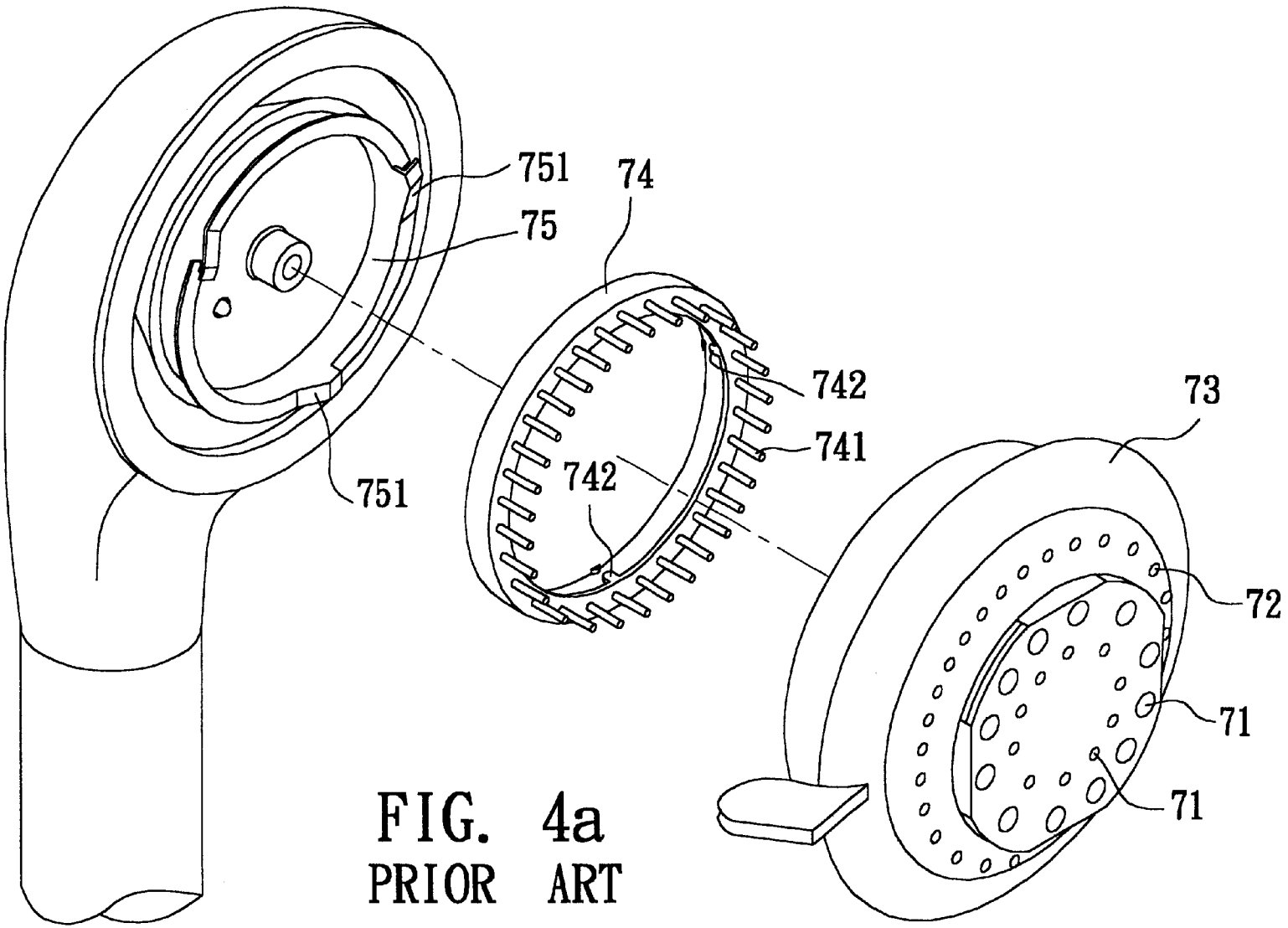
FIG. 4a PRIOR ART
FIG. 4*a* is a partially exploded view of a conventional sprinkler.
Figure 4B:
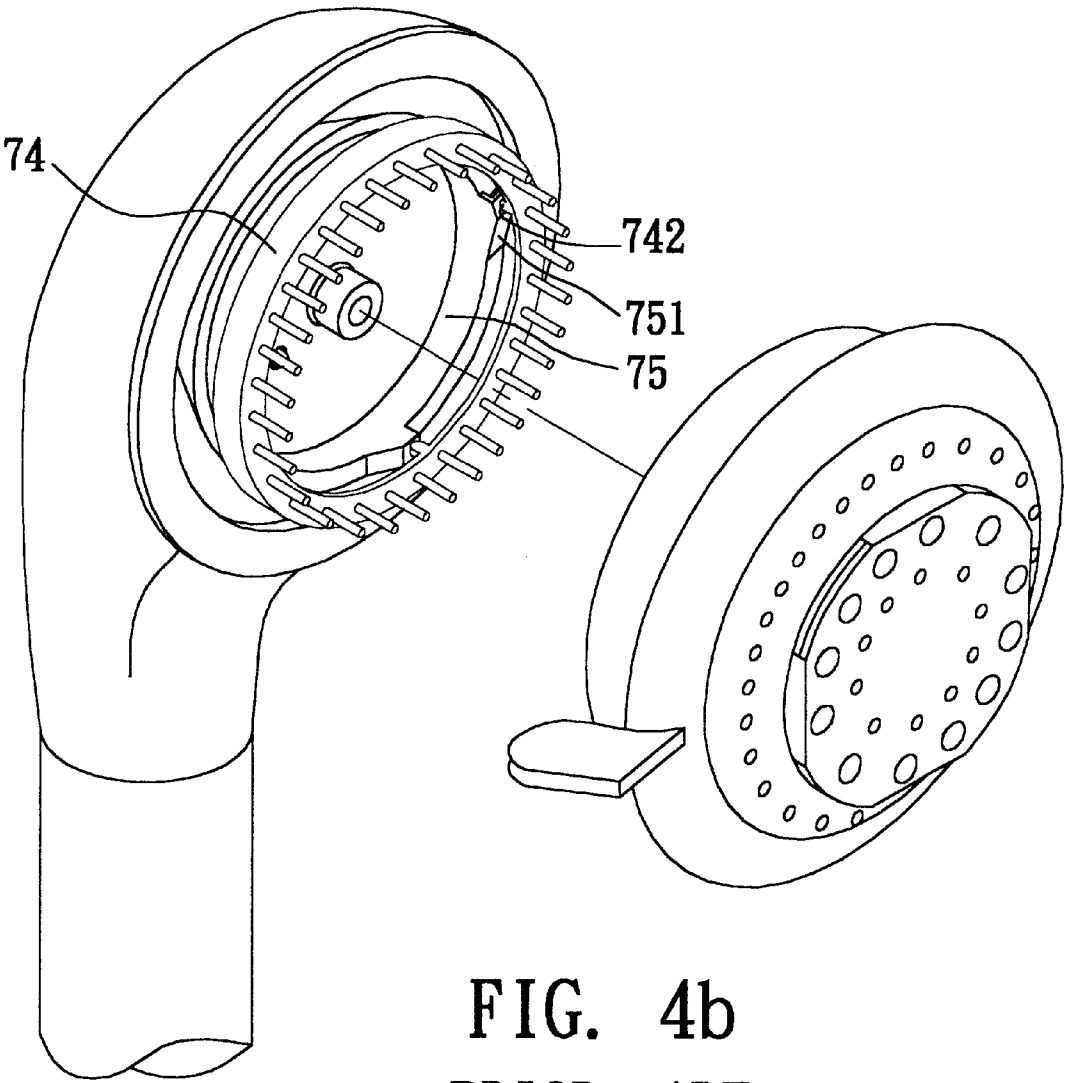
FIG. 4b PRIOR ART
FIG. 4*b* is a view according to FIG. 4*a*, showing the installation of the fixing tray and the ring.
Figure 5B:
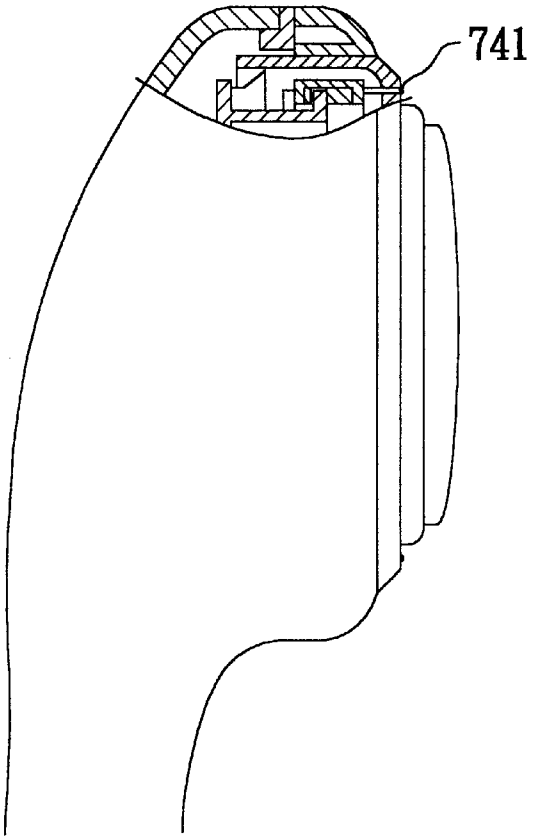
FIG. 5b PRIOR ART
FIG. 5*b* is a partially sectional view of the conventional sprinkler, showing that the cleaning pin is passed through the sprinkling hole.
Figure 5A:
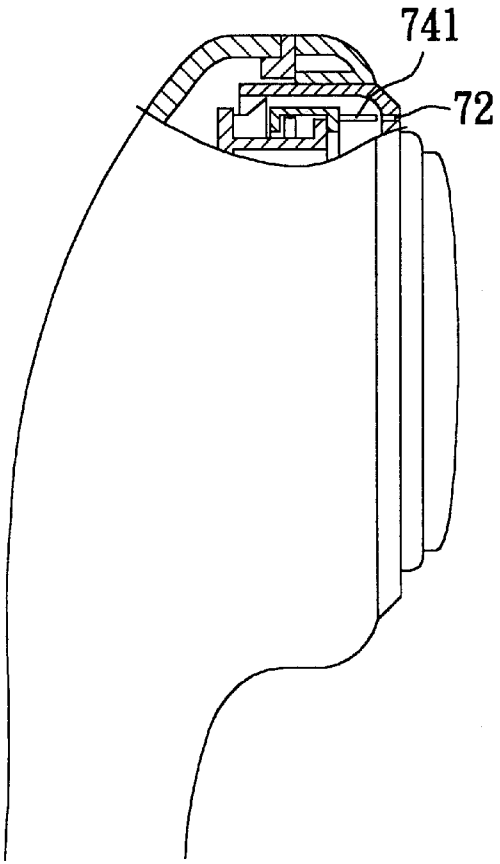
FIG. 5a PRIOR ART
FIG. 5*a* is a partially sectional view of the conventional sprinkler, showing that the cleaning pin is not passed through the sprinkling hole.

In addition, as shown in FIGS. 3*a* and 3*b*, when upward pushing the base seat 1, the bottom face of the base seat 1 will move upward to get close to the bottom edge of the adjustment seat 2. The locating blocks 22 of the adjustment seat 2 are inserted into the locating dents 122 of the hollow column 12 so that the base seat 1 is prevented from rotating. Therefore, the cleaning pins 23 can be just passed through the sprinkling holes 13 around the bubbling hole 11 to clear off the dirt attaching to the wall faces of the sprinkling holes 13. The O-ring 24 serves to tightly abut against the inner wall face of the base seat 1 to help in preventing the base seat 1 from slipping down.

According to the above structure, the bottom edge of the adjustment seat 2 of the wave generator is directly formed with multiple downward extending cleaning pins 23 corresponding to the sprinkling holes 13. When a user upward pushes the base seat 1 to switch the water flow to flow out from the bubbling hole 11, the cleaning pins 23 are simultaneously passed through the sprinkling holes 13 to remove the dirt attaching to the wall faces of the sprinkling holes 13. Therefore, it is unnecessary to additionally mount any other part in the quite limited internal space of the wave generator. Therefore, it is unnecessary to manufacture these parts and troublesomely assemble these parts.

In addition, when cleaning the sprinkling holes 13, the base seat 1 is directly pushed upward to make the cleaning pins 23 relatively pass through the sprinkling holes 13. Therefore, the base seat is linearly moved and not rotated. Accordingly, the base seat 1 can be easily moved.

Furthermore, the user often keeps the base seat 1 of the wave generator in an upward moved state, permitting the water to flow out from the bubbling hole 11 to form water flow with bubbles. Therefore, in normal state, the cleaning pins 23 are passed through the sprinkling holes 13 so that the dirt is harder to attach to the wall faces of the sprinkling holes 13.

In addition, the top sections of the base seat 1 and the adjustment seat 2 are respectively formed with corresponding slopes 141, 211. Therefore, when the adjustment seat 2 is fitted into the base seat, the slopes 141, 211 guide each other to ensure that the adjustment seat 2 be straightly fitted into the base seat 1 with the cleaning pins 23 accurately passed through the sprinkling holes 13.

Moreover, when the adjustment seat 2 is fitted with the base seat 1, the locating blocks 22 are inserted into the locating dents 122 so as to avoid rotation of the adjustment seat 2 relative to the base seat 1. Therefore, the cleaning pins 23 can be truly passed through the sprinkling holes 13.

An outer case can be fitted around the base seat and connected with the base seat by way of engagement or ultrasonic fusion.

The above embodiments are only used to illustrate the present invention, not intended to limit the scope thereof. Many modifications of the above embodiments can be made without departing from the spirit of the present invention.

What is claimed is:

1. A wave generator for mounting on a faucet, comprising a base seat and an annular adjustment seat, a center of bottom face of the base seat being formed with a bubbling hole, a hollow column upward extending from a circumference of the bubbling hole, a bottom face of the base seat being formed with multiple annularly arranged sprinkling holes between the hollow column and inner wall face of the base seat, the adjustment seat being inserted between the hollow column and the inner wall face of the base seat, a switch member being disposed in the adjustment seat, whereby by means of moving the base seat up and down, the relative positions of the hollow column and the switch member are changeable so as to selectively discharge water from the bubbling hole or the sprinkling holes, said wave generator being characterized in that bottom edge of the adjustment seat is formed with multiple downward extending parallel cleaning pins respectively corresponding to the sprinkling holes, whereby when the base seat is moved upward, permitting the water to flow out from the bubbling hole, the cleaning pins are respectively passed through the sprinkling holes.

2. The wave generator as claimed in claim 1, wherein a hollow column upward extends from the circumference of the bubbling hole, an outer face of the hollow column being formed with multiple annular arranged locating dents, the locating dents axially extending up to the top of the base seat, the inner wall face of the adjustment seat being formed with multiple inward projecting locating blocks corresponding to the locating dents, whereby the locating blocks can be inserted into the locating dents to avoid rotation of the base seat.

3. The wave generator as claimed in claim 1, wherein at least one O-ring is fitted around the adjustment seat.

4. The wave generator as claimed in claim 1, wherein the top edge of the base seat is formed with an inward and downward inclined slope and the top section of the adjustment seat has an outward projecting flange with an outer diameter larger than the inner diameter of the top edge of the base seat, the bottom face of the flange being formed with a downward and inward inclined slope corresponding to the slope of the base seat, whereby the slopes guide each other to ensure that the adjustment seat and the base seat be straightly fitted with each other.

5. The wave generator as claimed in claim 1, wherein the base seat is integrally molded.

6. The wave generator as claimed in claim 1, wherein an outer case is fitted around the base seat.

* * * * *